US007544059B2

(12) United States Patent
Gartz

(10) Patent No.: US 7,544,059 B2
(45) Date of Patent: Jun. 9, 2009

(54) DOOR SEALING DEVICE FOR INDUSTRIAL FURNACE

(75) Inventor: Mats Gartz, Sollentuna (SE)

(73) Assignee: AGA AB, Lidingo (SE)

( * ) Notice: Subject to any disclaimer, the term of this patent is extended or adjusted under 35 U.S.C. 154(b) by 57 days.

(21) Appl. No.: 11/802,808

(22) Filed: May 25, 2007

(65) Prior Publication Data

US 2008/0223264 A1 Sep. 18, 2008

(30) Foreign Application Priority Data

Mar. 14, 2007 (SE) ..... 0700628

(51) Int. Cl.
*F27D 1/18* (2006.01)

(52) U.S. Cl. ..... 432/237; 432/250; 110/173 R; 110/180

(58) Field of Classification Search ..... 432/237, 432/250, 57; 110/180, 173 R, 181; 266/263, 266/283

See application file for complete search history.

(56) References Cited

U.S. PATENT DOCUMENTS

| | | | | |
|---|---|---|---|---|
| 2,233,650 | A * | 3/1941 | Swartz | 110/180 |
| 2,254,900 | A * | 9/1941 | Lessmann | 34/242 |
| 2,804,855 | A * | 9/1957 | Bergman | 122/498 |
| 3,045,994 | A * | 7/1962 | Longenecker | 432/237 |
| 3,618,919 | A * | 11/1971 | Beck | 432/237 |
| 5,733,116 | A * | 3/1998 | Tanno et al. | 432/244 |
| 5,813,180 | A * | 9/1998 | Whitney et al. | 52/270 |
| 6,625,931 | B2 * | 9/2003 | Omori et al. | 49/440 |
| 6,679,246 | B2 * | 1/2004 | Strolz et al. | 126/190 |

* cited by examiner

*Primary Examiner*—Gregory A Wilson
(74) *Attorney, Agent, or Firm*—Young & Thompson

(57) ABSTRACT

Each one of the side edges (4*a*, 4*b*) of a door (3) is arranged to run inside and along a respective tube (5*a*, 5*b*) that has a longitudinal slit (6*a*, 6*b*) and extends vertically, in that each tube is fixed in relation to the furnace, in that the tubes (5*a*, 5*b*) are designed to spring back towards a respective position in which the slit (6*a*, 6*b*) is closed, and arranged to enclose the side edge (4*a*, 4*b*) of the door (3) along essentially the whole length of the side edge (4*a*, 4*b*) when the door (3) is in its closed position, and in that a liquid coolant is arranged to stream through the tubes (5*a*, 5*b*) and essentially fill up the whole space defined by the combination of the inner surfaces of each tube (5*a*, 5*b*) and the outer surfaces of the respective side part of the door (3).

20 Claims, 5 Drawing Sheets

DOOR SEALING DEVICE FOR INDUSTRIAL FURNACE

BACKGROUND OF THE INVENTION

1. Field of the Invention

The present invention relates to a door sealing device for an industrial furnace. More specifically, the invention relates to vertical sealing devices intended for use in conjunction with vertically arranged doors to an industrial furnace.

2. Description of the Related Art

Today, industrial furnaces are used for heating of various materials, such as metals. In order to avoid unnecessary thermal losses during operation, openable doors are used with the industrial furnaces, which can be sealed when no material at the moment needs transportation into or out of the furnace. Generally, such doors are arranged vertically, and are consequently opened or closed using a vertical door movement. Advantageously, the door is opened by raising it and closed by again lowering it.

A problem associated with the operation of this type of doors is that it is difficult to obtain a satisfying seal between the moving side wall of the door and the wall of the industrial furnace. Such a seal is desirable in order to avoid thermal losses, leakage of outside air into the furnace and leakage of flue gases, etc. Because of the elevated temperatures inside the industrial furnace, it is difficult to find sealing materials with sufficient life times in the inhospitable environment surrounding the edge of the door.

SUMMARY OF THE INVENTION

The present invention solves the above problem.

Thus, the present invention relates to a door sealing device for an industrial furnace which is vertical and opened vertically, and is characterized in that each one of the side edges of the door is arranged to run inside and along a respective tube that has a longitudinal slit and extends vertically, in that each tube is fixed in relation to the furnace, in that the tubes are designed to spring back towards a respective position in which the slit is closed, and arranged to enclose the side edge of the door along essentially the whole length of the side edge when the door is in its closed position, and in that a liquid coolant is arranged to stream through the tubes and essentially fill up the whole space defined by the combination of the inner surfaces of each tube and the outer surfaces of the respective side parts of the door.

BREIF DESCRIPTIONS OF THE DRAWINGS

In the following the invention will be described in closer detail, partly in connection with exemplifying embodiments of the invention, and with reference to the accompanying drawings, where:

Figure 3A:
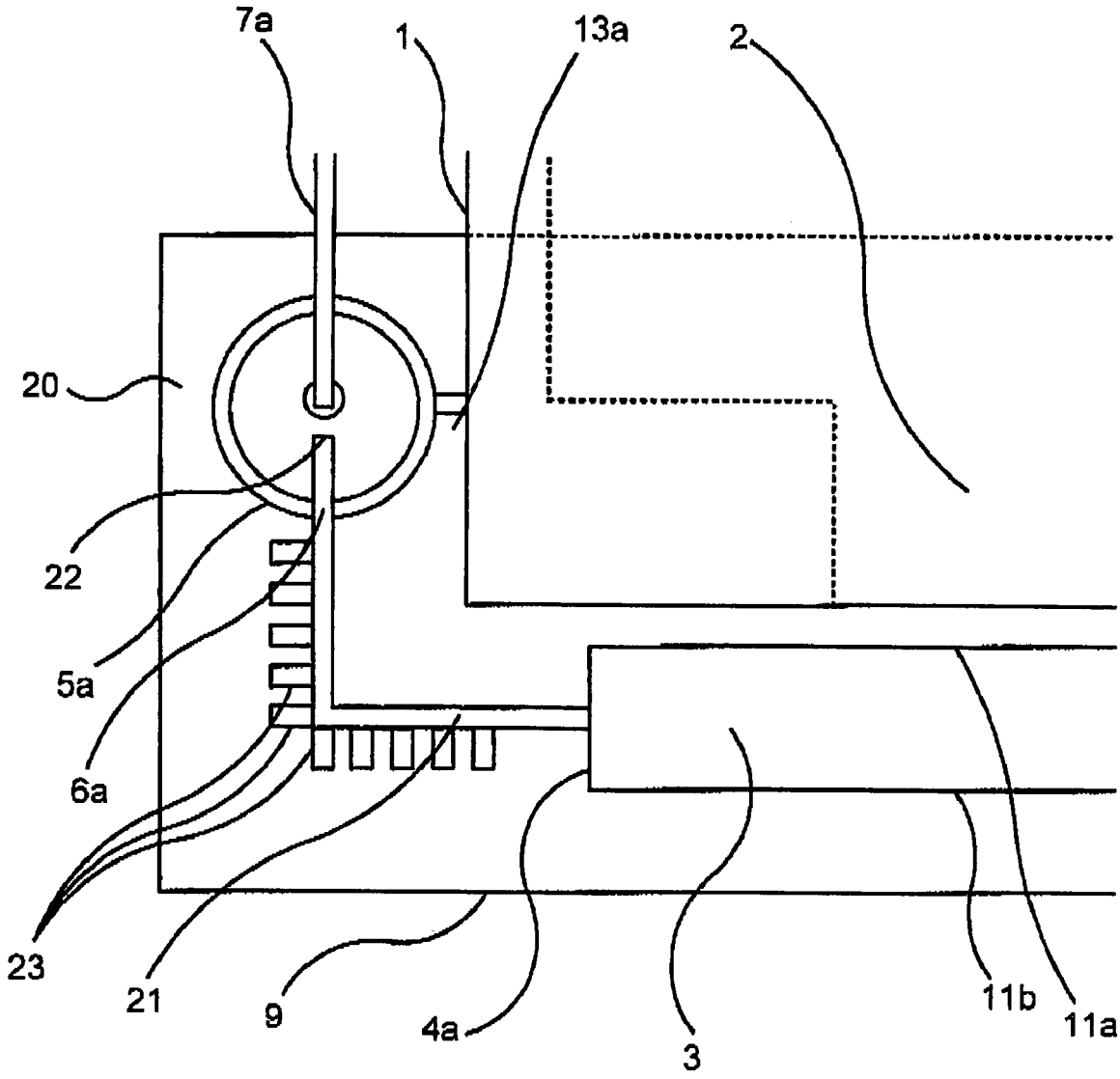

FIG. 3*a* is a detail view of a first preferred edge sealing device in cross-section as seen from the top according to the present invention.

Figure 3B:
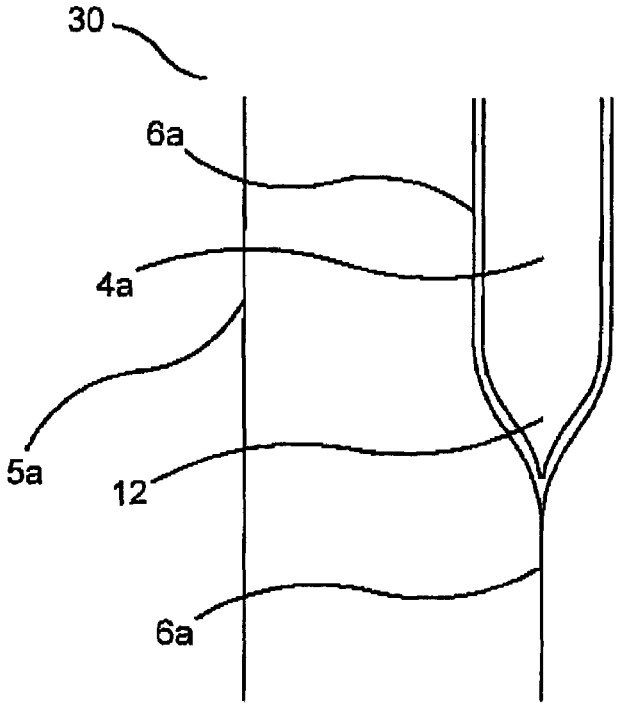

FIG. 3*b* is a detail view of a second preferred edge sealing device from the side according to the present invention.

Figure 3C:
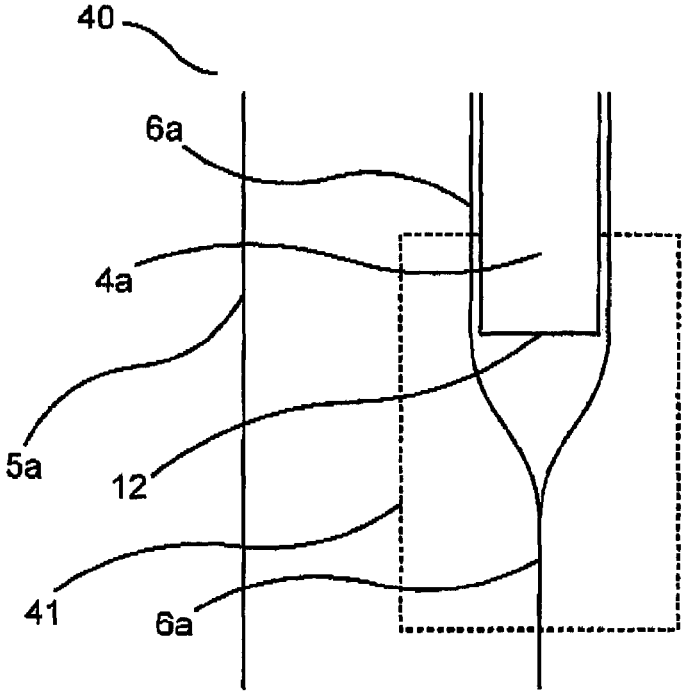

FIG. 3*c* is a detail view of a third preferred edge sealing device from the side according to the present invention.

Figure 3D:
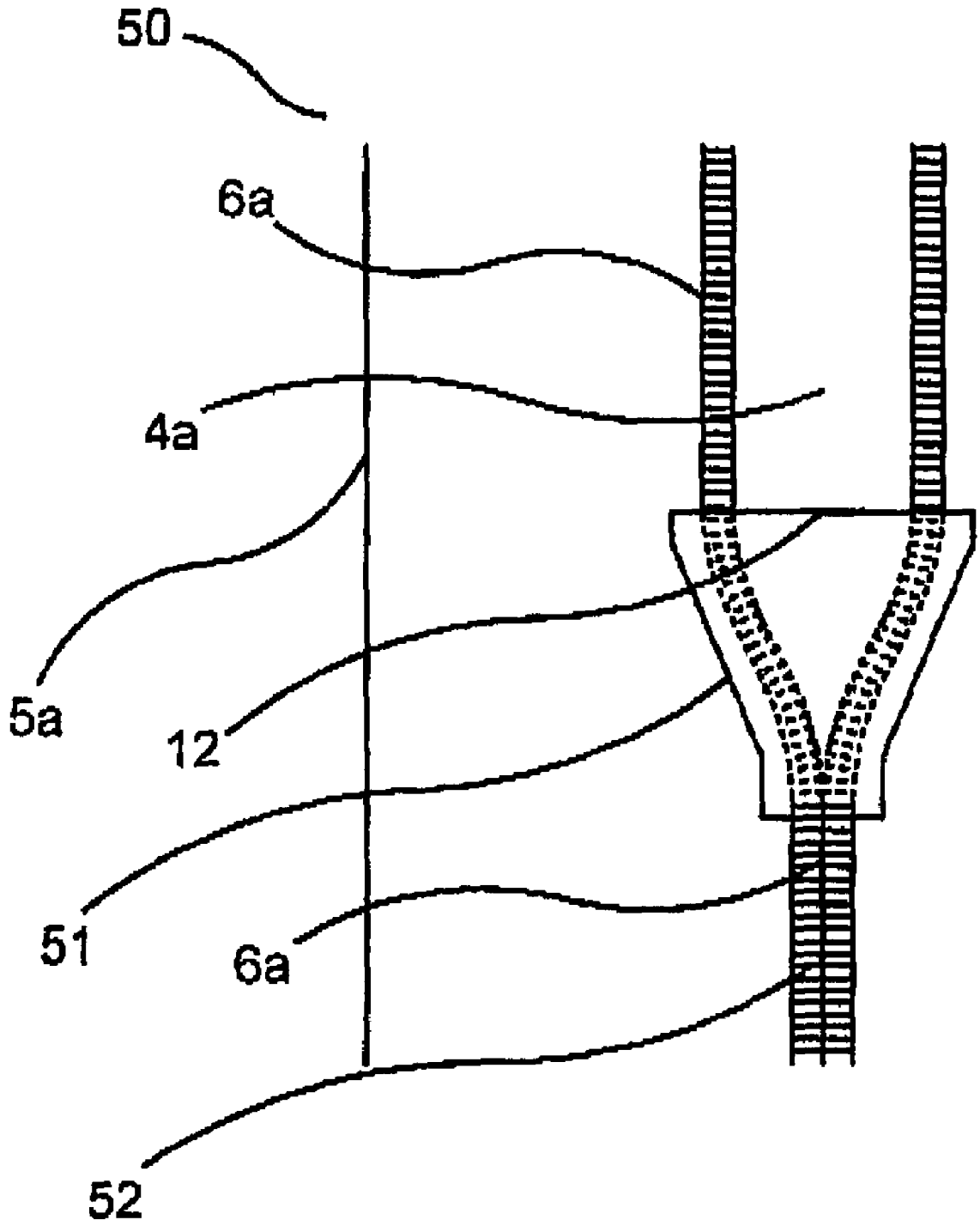

FIG. 3*d* is a detail view of a fourth preferred edge sealing device from the side according to the present invention.

DESCRIPTION OF THE PREFERRED EMBODIMENTS

Figure 1:
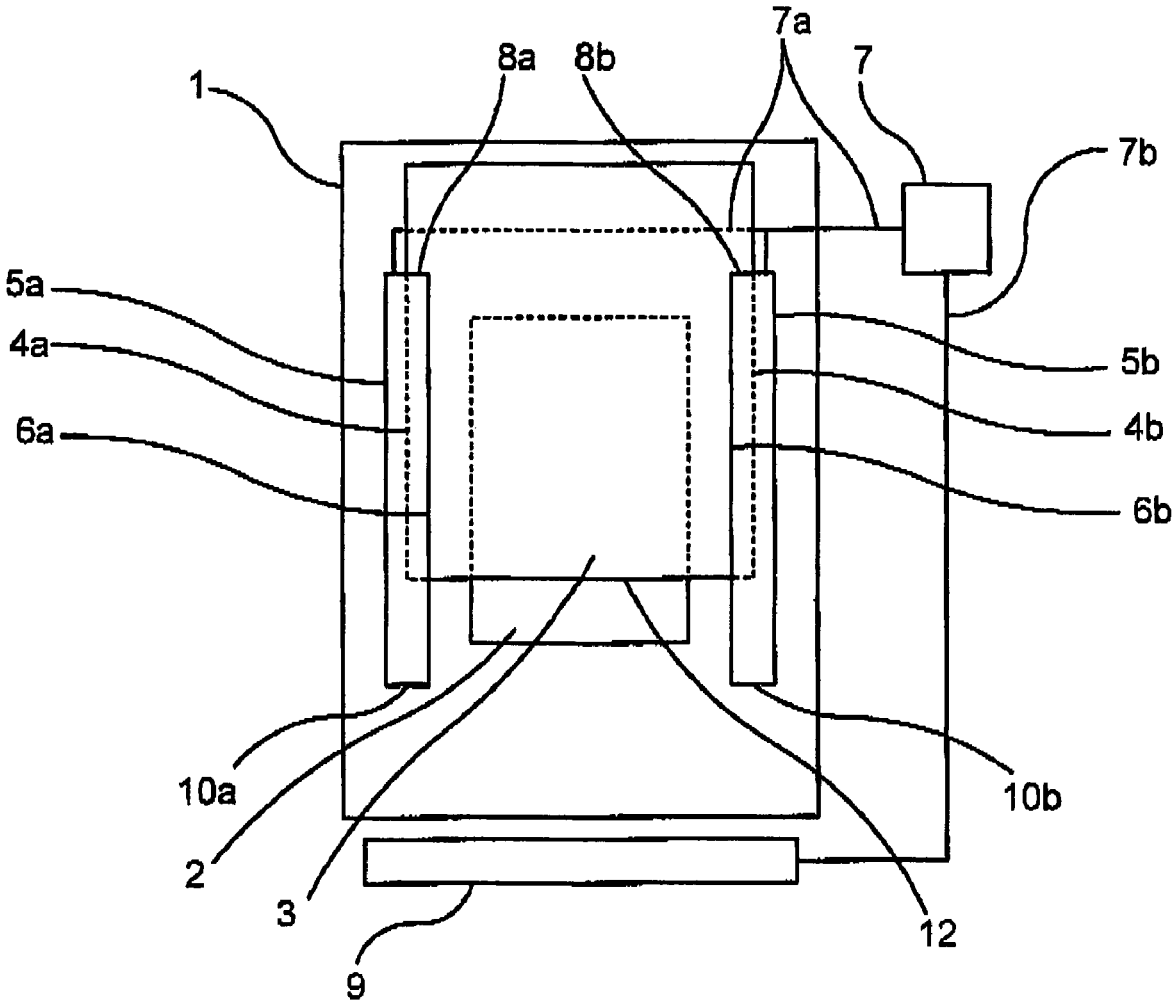
FIG. 1 is a simplified front view of a preferred door sealing device according to the present invention.
Figure 2:
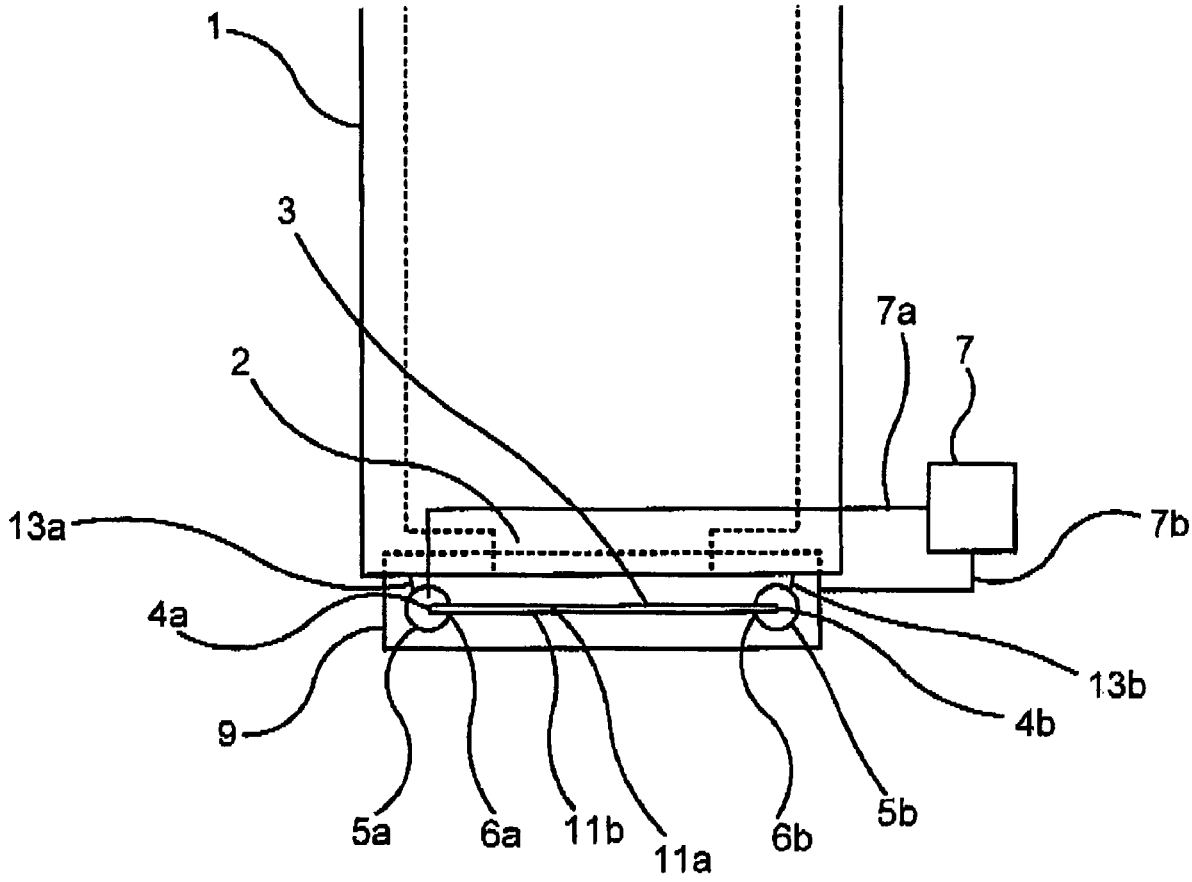
FIG. 2 is a simplified top view of the preferred door sealing device according to FIG. 1.

With common reference numerals, in FIG. 1 and in FIG. 2 are shown an industrial furnace 1, which in one of its side walls is equipped with a through opening 2 for bringing material into or out of the furnace 1. A vertically arranged and openable door 3 is arranged to tightly cover the through opening 2. The door 3 is opened by bringing it upwards, and is reclosed by lowering it back to its original position. In the drawings, the door 3 is shown in a partly open position.

Both vertical side edges 4*a*, 4*b* of the door 3 each run inside a respective vertically arranged tube 5*a*, 5*b*, extending essentially along the whole length of its respective side edge 4*a*, 4*b* when the door 3 is in its closed position. Each of the respective tubes 5*a*, 5*b* is furnished with a longitudinal slit 6*a*, 6*b*, through which slit the respective side edge 4*a*, 4*b* is inserted. Thus, both side edges 4*a*, 4*b* of the door 3 are arranged to completely be surrounded by their respective tubes 5*a*, 5*b* when the door 3 is in its closed position. When the door 3 is opened or closed, its side edges 4*a*, 4*b* run inside the tubes 5*a*, 5*b* in the longitudinal, essentially vertical, direction of the tubes 5*a*, 5*b*.

A circulation device 7 for liquid coolant is arranged to continuously let coolant flow through the tubes 5*a*, 5*b*. In order to achieve this, the circulation device 7 supplies coolant, via supply conduits 7*a*, at the upper opening 8*a*, 8*b* of each respective tube 5*a*, 5*b*, and collects the coolant in a trough 9 which is arranged straight below the lower openings 10*a*, 10*b* of both respective tubes 5*a*, 5*b*, through which the coolant flows, and the circulation device 7 is arranged to transport the coolant, via a return conduit 7*b*, back to the supply site by the help of a pumping device (not shown).

Preferably, the coolant is water, but it can be constituted of any suitable, liquid coolant.

The tubes 5*a*, 5*b* are manufactured from an elastic material, such as for example rubber. Since the coolant continuously flows through the tubes 5*a*, 5*b*, the tubes 5*a*, 5*b* are effectively cooled during operation, and it is therefore possible to achieve a satisfactory life time for the tubes 5*a*, 5*b*. Furthermore, both the respective tubes 5*a*, 5*b* are arranged to spring back, by the help of the elastic nature of the material of manufacture, towards a position in which the slit 6*a*, 6*b* is closed. This leads to the tube 5*a*, 5*b*, through the spring action, tightly closing against both the interior side 11*a* and the external side 11*b* of the door 3. See FIG. 2. Thus, leakage of coolant through the slit 6*a*, 6*b* is minimized.

The tubes 5*a*, 5*b* are tight-fittingly fastened to the external wall of the industrial furnace 1 by the aid of sealing fastening means 13*a*, 13*b*. Furthermore, an overpressure arises inside the tubes 5*a*, 5*b* because of the liquid column of coolant inside the tubes 5*a*, 5*b*, this leads to the volume defined by the interior surfaces of the tubes 5*a*, 5*b* in combination with the exterior surfaces of the side portions of the door 3 always being completely filled with coolant during operation. By the side portions of the door 3 is meant the side edges 4*a*, 4*b* of the door 3 as well as the small portion of the inner 11*a* and outer 11*b* surfaces of the door 3 being inserted inside the respective tube 5*a*, 5*b*. In this way, an efficient sealing of the side edges 4*a*, 4*b* of the door 3 is achieved. Also, the door 3 is sealed in a conventional manner along its lower and its upper edges, respectively, by the use of sealing devices that are not, for reasons of simplicity, shown in the drawings. All in all, a satisfactory seal of the door 3 is thus achieved, so that atmospheric air cannot leak into the industrial furnace 1, and so that furnace atmosphere gases cannot leak out of the industrial furnace 1 through any of the edges of the door 3.

Since the tubes 5*a*, 5*b* are arranged to spring back against a position in which their respective slits 6*a*, 6*b* are closed, this sealing effect is achieved both in those places where the side edges 4*a*, 4*b* of the door 3 run through the slits 6*a*, 6*b*, and where the side edges 4*a*, 4*b* of the door 3 do not run through the slits 6*a*, 6*b* because of the door 3 having been partly opened.

However, a certain leakage of coolant through the slits 6*a*, 6*b* can be acceptable, and is in this case caught by the trough 9 for return to the circulation device 7. Such leakage will especially be present partly further down along the tubes 5*a*, 5*b*, because of the increasing pressure in the tubes 5*a*, 5*b* due to increasing liquid depth partly in the area where the slit 6*a*, 6*b* is being closed or being opened around the lower edge 12 of the door 3 when the door 3 is opened or closed. However, in certain cases it may be desirable to minimize such leakage of coolant.

A preferred way to achieve such a minimization of leakage through the slits 6*a*, 6*b* is to design the tubes 5*a*, 5*b* so that the spring action, leading to each tube 5*a*, 5*b* springing back towards a position where its slit 6*a*, 6*b* is closed, increases downwards in the longitudinal direction of the tube 5*a*, 5*b*. By way of example, this can be achieved by making the tube 5*a*, 5*b* stiffer and/or thicker further down as compared to further up, or by arranging additional, circular springs (not shown), contributing to further increase of the return springing action of the tube 5*a*, 5*b* further down on the same.

Furthermore, it is preferred to minimize the leakage through the slits 6*a*, 6*b* by the provision to the door sealing device of a special edge sealing device, specifically minimizing the leakage which would otherwise risk to arise through the particular area in which the slit 6*a*, 6*b* is closing or opening around the lower edge 12 of the door 3 when the door 3 is opened or closed. Preferred examples of such edge sealing devices are illustrated in FIGS. 3*a* to 3*d*. FIGS. 3*a* to 3*d* only show detail views of one of the above-described edges 4*a*, 4*b*, even though both of the edges 4*a*, 4*b* are preferably but not necessarily furnished with identical edge sealing devices. Moreover, reference numerals are still common between the different figures.

Thus, FIG. 3*a* shows a first preferred edge sealing device 20 according to the present invention. The side edge 4*a* of the door 3 is provided with a piece of sheet metal 21 mounted on the outside of the side edge 4*a*, and tight-fittingly attached along with the complete vertical elongation of the edge 4*a*, and extending outwards some distance in the plane of the door 3, and further bending around the side of the industrial furnace 1, and thereafter running a certain distance along this side. In this preferred embodiment, the tube 5*a* is arranged along a side of the industrial furnace 1 which is adjacent to the side through which the through opening 2 is arranged. Furthermore, it is the external side portion 22 of the sheet metal 21 which is inserted through the slit 6*a*, 6*b*, and which is consequently arranged to be displaced inside and along the tube 5*a* when the door 3 is opened or closed.

The sheet metal 21 is essentially thinner than the door 3. In order to avoid thermal damage to the sheet metal 21, it is arranged to be cooled separately from the door 3. For example, this can be arranged by the help of cooling flanges 23 mounted on the side of the sheet metal 21 facing outwards. Furthermore, the circulation device 7 can be arranged to let part of the supplied coolant flow over the side of the sheet metal 21 facing outwards, so that a thin film of coolant continuously is reformed on the surface of the sheet metal 21 from above, and thus cools the sheet metal 21.

Because of the small thickness of the sheet metal 21, the leakage of coolant through the slit 6*a* is minimized at the location where the slit 6*a* is closing or opening around the lower edge of the sheet metal 21 when the door 3 is being opened or closed.

Finally, in this preferred embodiment the trough 9 is arranged to be sufficiently large in order to capture leaking coolant, even in case the tube 5*a* is arranged on a side of the industrial furnace which is not the same side as the one where the through opening 2 is arranged.

FIG. 3*b* is a detail view from the side illustrating a second preferred edge sealing device 30. Thus, FIG. 3*b* shows the tube 5*a* with its accompanying slit 6*a* from the side at the very location where the slit 6*a* at the moment is closing around the lower edge 12 of the door 3. As is clearly seen in FIG. 3*b*, the lower edge 12 of the door 3 in this preferred embodiment is designed with a form that tapers off in the longitudinal direction of the side edge 4*a* of the door 3, where the tapered form essentially follows the form naturally assumed by the slit 6*a* at the closing location when the tube 5*a* closes around the termination of the lower edge 12 of the door 3 against the side edge 4*a* of the door 3. This naturally arisen form of the slit 6*a* arises as a consequence of the elastic nature of the material of the tube 5*a*.

Thus, when the door 3 moves upwards or downwards along the slit 6*a*, by opening or closing the door 3, the slit 6*a* will always assume essentially the same form as will the termination of the lower edge 12 of the door 3 against the side edge 4*a* of the door 3, and consequently the slit 6*a* will connect essentially tight-fittingly against the termination of the lower edge 12 of the door 3 against the side edge 4*a* of the door 3. This leads to better sealing between the door and the tube 5*a*, together with the associated advantages with minimized leakage of coolant through the slit 6*a*.

FIG. 3*c* shows a third preferred edge sealing device 40, shown from the same perspective as that in FIG. 3*b*. As is illustrated in FIG. 3*c*, the lower edge 12 of the door 3 comprises a sealing device 41, fixed to the door 3 and running inside the tube 5*a* and arranged to tight-fittingly bear against the interior surface of the tube 5*a* from the inside, and thereby to seal the area of connection between the tube 5*a* and the termination of the lower edge 12 of the door 3 against the side edge 4*a* of the door 3.

Thereby, the same advantages as described in connection with the second preferred edge sealing device 30 are achieved.

FIG. 3*d* shows a fourth preferred edge sealing device 50, like FIG. 3*c* shown from the same perspective as that of FIG. 3*b*. As is illustrated in FIG. 3*c*, the slit 6*a* of the tube 5*a* and the lower edge 12 of the door 3 comprise cooperating zip type locking means 51, 52, arranged to close the slit 6*a* of the tube 5*a* after the lower edge 12 of the door 3 when the door 3 is being opened, and reversely to open the slit 6*a* of the tube 5*a* in front of the lower edge 12 of the door 3 when the door 3 is being closed. Those sections of the zip lock which are closed are arranged to be essentially impenetrable to the coolant, leading to the same advantages in terms of good sealing as described in connection with the second preferred edge sealing device 30.

The cooperating locking means 51, 52 are preferably of the type with good sealing effect used in dry suits, even if the dimension of the locking means 51, 52 naturally can be greatly varied depending on the size of the door 3 and of the tube 4*a*.

It should be realized that the preferred edge sealing devices 20, 30, 40, 50 can be used individually or together in various combinations. Also, it is not in all applications necessary to additionally seal the edge of the door 3 at all. Furthermore, it is possible to use the present invention together with other, conventional or today unknown edge sealing devices without departing from the basic idea of the invention.

Above, the present invention has been explained with reference to exemplifying embodiments. However, it should be realized that the invention should not be considered limited by these embodiments, but the invention can be varied within the scope of the attached claims.

The invention claimed is:

1. Door sealing device for an industrial furnace which is vertical and opened vertically, characterized in that each one of the side edges (4*a*, 4*b*) of the door (3) is arranged to run within and along a respective elastic tube (5*a*, 5*b*) that has a longitudinal slit (6*a*, 6*b*) and extends vertically, in that each tube is fixed in relation to the furnace, in that the tubes (5*a*, 5*b*) are designed to spring back towards a respective position in which the slit (6*a*, 6*b*) is closed, and arranged to enclose the side edge (4*a*, 4*b*) of the door (3) along essentially the whole length of the side edge (4*a*, 4*b*) when the door (3) is in its closed position, and in that a liquid coolant is arranged to stream through the tubes (5*a*, 5*b*) and essentially fill up the whole space defined by the combination of the inner surfaces of each tube (5*a*, 5*b*) and the outer surfaces of the respective side part of the door (3).

2. Door sealing device according to claim 1, characterized in that the side edge (4*a*, 4*b*) of the door (3) is slidably arranged inside the tube (5*a*, 5*b*), so that the door (3) is slidable upwards and downwards along the longitudinal direction of the tube (5*a*, 5*b*) and so that the door (3) thereby is opened or closed to the industrial furnace (1).

3. Door sealing device according to claim 2, characterized in that the lower edge (12) of the door (3) is designed with a form which tapers off downwards in the longitudinal direction of the side edge (12) of the door (3), where the tapered form essentially follows that form which is adopted naturally by the slit (6*a*, 6*b*) at the location for closing when the tube (5*a*, 5*b*) is closing around the termination of the lower edge (12) of the door (3) against the side edge (4*a*, 4*b*) of the door (3).

4. Door sealing device according to claim 2, characterized in that the lower edge (12) of the door (3) comprises a sealing device (41) which is fixed to the door (3) and runs inside the tube (5*a*, 5*b*), and which is arranged to tight-fittingly bear against the interior surface of the tube (5*a*, 5*b*) and thereby seal the connection between the tube (5*a*, 5*b*) and the termination of the lower edge (12) of the door (3) against the side edge (4*a*, 4*b*) of the door (3).

5. Door sealing device according to claim 2, characterized in that the slit (6*a*, 6*b*) of the tube (5*a*, 5*b*) and the lower edge (12) of the door (3) comprise cooperating locking means (51, 52) of zip type, that are arranged to tight-fittingly seal the slit (6*a*, 6*b*) of the tube (5*a*, 5*b*) after the lower edge (12) of the door (3) as the door (3) is opening, and reversely open the slit (6*a*, 6*b*) of the tube (5*a*, 5*b*) in front of the lower edge (12) of the door (3) as the door (3) is closing, and in that the closed section of the zip lock is arranged to be essentially impenetrable to the coolant.

6. Door sealing device according to claim 2, characterized in that the coolant is water.

7. Door sealing device according to claim 2, characterized in that trough 9 is arranged under the tube (5*a*, 5*b*), and in that the trough (9) is arranged to collect coolant leaking from the tube (5*a*, 5*b*).

8. Door sealing device according to claim 2, characterized in that the side edge (4*a*, 4*b*) of the door (3) comprises a piece of sheet metal (21) essentially arranged outside of the main body of the door (3), whereby it is the outer side portion (22) of the sheet metal (21) that runs inside the tube (5*a*, 5*b*).

9. Door sealing device according to claim 2, characterized in that the lower edge (12) of the door (3) is designed with a form which tapers off downwards in the longitudinal direction of the side edge (12) of the door (3), where the tapered form essentially follows that form which is adopted naturally by the slit (6*a*, 6*b*) at the location for closing when the tube (5*a*, 5*b*) is closing around the termination of the lower edge (12) of the door (3) against the side edge (4*a*, 4*b*) of the door (3).

10. Door sealing device according to claim 1, characterized in that the coolant is water.

11. Door sealing device according to claim 10, characterized in that trough 9 is arranged under the tube (5*a*, 5*b*), and in that the trough (9) is arranged to collect coolant leaking from the tube (5*a*, 5*b*).

12. Door sealing device according to claim 10, characterized in that the side edge (4*a*, 4*b*) of the door (3) comprises a piece of sheet metal (21) essentially arranged outside of the main body of the door (3), whereby it is the outer side portion (22) of the sheet metal (21) that runs inside the tube (5*a*, 5*b*).

13. Door sealing device according to claim 10, characterized in that the lower edge (12) of the door (3) is designed with a form which tapers off downwards in the longitudinal direction of the side edge (12) of the door (3), where the tapered form essentially follows that form which is adopted naturally by the slit (6*a*, 6*b*) at the location for closing when the tube (5*a*, 5*b*) is closing around the termination of the lower edge (12) of the door (3) against the side edge (4*a*, 4*b*) of the door (3).

14. Door sealing device according to claim 1, characterized in that trough 9 is arranged under the tube (5*a*, 5*b*), and in that the trough (9) is arranged to collect coolant leaking from the tube (5*a*, 5*b*).

15. Door sealing device according to claim 14, characterized in that the side edge (4*a*, 4*b*) of the door (3) comprises a piece of sheet metal (21) essentially arranged outside of the main body of the door (3), whereby it is the outer side portion (22) of the sheet metal (21) that runs inside the tube (5*a*, 5*b*).

16. Door sealing device according to claim 1, characterized in that the side edge (4*a*, 4*b*) of the door (3) comprises a piece of sheet metal (21) essentially arranged outside of the main body of the door (3), whereby it is the outer side portion (22) of the sheet metal (21) that runs inside the tube (5*a*, 5*b*).

17. Door sealing device according to claim 16, characterized in that the sheet metal (21) is provided with external cooling flanges (23).

18. Door sealing device according to claim 17, characterized in that the sheet metal (21) is arranged to be cooled with the aid of a coolant flowing along the external side surface of the sheet metal (21), where the coolant is identical, and is discharged from the same source, as the coolant flowing through the tube (5*a*, 5*b*).

19. Door sealing device according to claim 16, characterized in that the sheet metal (21) is arranged to be cooled with the aid of a coolant flowing along the external side surface of the sheet metal (21), where the coolant is identical, and is discharged from the same source, as the coolant flowing through the tube (5*a*, 5*b*).

20. Door sealing device according to claim 1, characterized in that the tube (5*a*, 5*b*) is designed with a more powerful spring back action further down the tube (5*a*, 5*b*) than further up the tube (5*a*, 5*b*).

* * * * *